US005104588A

United States Patent [19]

Kinney, Jr.

[11] Patent Number: 5,104,588

[45] Date of Patent: Apr. 14, 1992

[54] PERFORATED TRAPEZOIDAL-SHAPED FILL BAR FOR SPLASH TYPE WATER COOLING TOWERS

[75] Inventor: Ohler L. Kinney, Jr., Leawood, Kans.

[73] Assignee: The Marley Cooling Tower Company, Mission, Kans.

[21] Appl. No.: 691,455

[22] Filed: Apr. 25, 1991

[51] Int. Cl.[5] ..... B01F 3/04

[52] U.S. Cl. ..... 261/111; 261/DIG. 11

[58] Field of Search ..... 261/111, DIG. 11

[56] References Cited

U.S. PATENT DOCUMENTS

| | | | |
|---|---|---|---|
| 3,389,895 | 6/1968 | DeFlon | 261/111 |
| 3,468,521 | 9/1969 | Furlong et al. | 261/111 |
| 3,647,191 | 3/1972 | Fordyce | 261/111 |
| 3,879,502 | 4/1975 | Furlong et al. | 261/111 |
| 4,181,691 | 1/1980 | Cates et al. | 261/111 |
| 4,576,764 | 3/1986 | Shepherd et al. | 261/111 |
| 4,578,227 | 3/1986 | Ovard | 261/111 |

*Primary Examiner*—Tim Miles

*Attorney, Agent, or Firm*—Hovey, Williams, Timmons & Collins

[57] ABSTRACT

An improved splash-type fill bar (32) for water cooling towers (10) is provided which gives enhanced water cooling as compared with conventional bars. The bars (32) are of trapezoidal configuration and present a flat, apertured top wall (36), a pair of obliquely oriented, downwardly and outwardly extending apertured sidewalls (42, 44) and short, horizontal, imperforate flange walls (50, 52) extending from the lower margins (46, 48) of the sidewalls (42, 44). The width of top wall (36) is at least four times the vertical height of a sidewall (42, 44) so as to present an effective water dispersal surface; the oblique sidewalls (42, 44) and flange walls (50, 52) prevent formation of gravitating sheets or films of water which can inhibit tower performance.

6 Claims, 5 Drawing Sheets

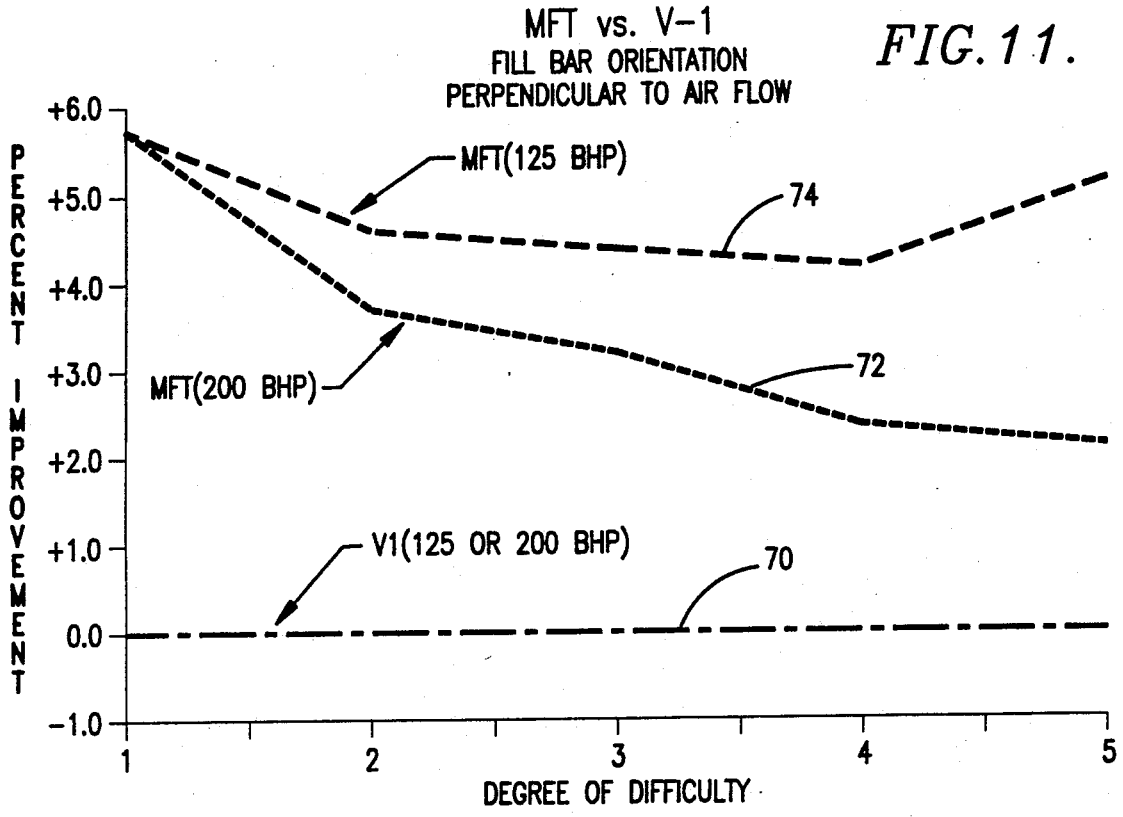
FIG. 11.
FIG. 12.
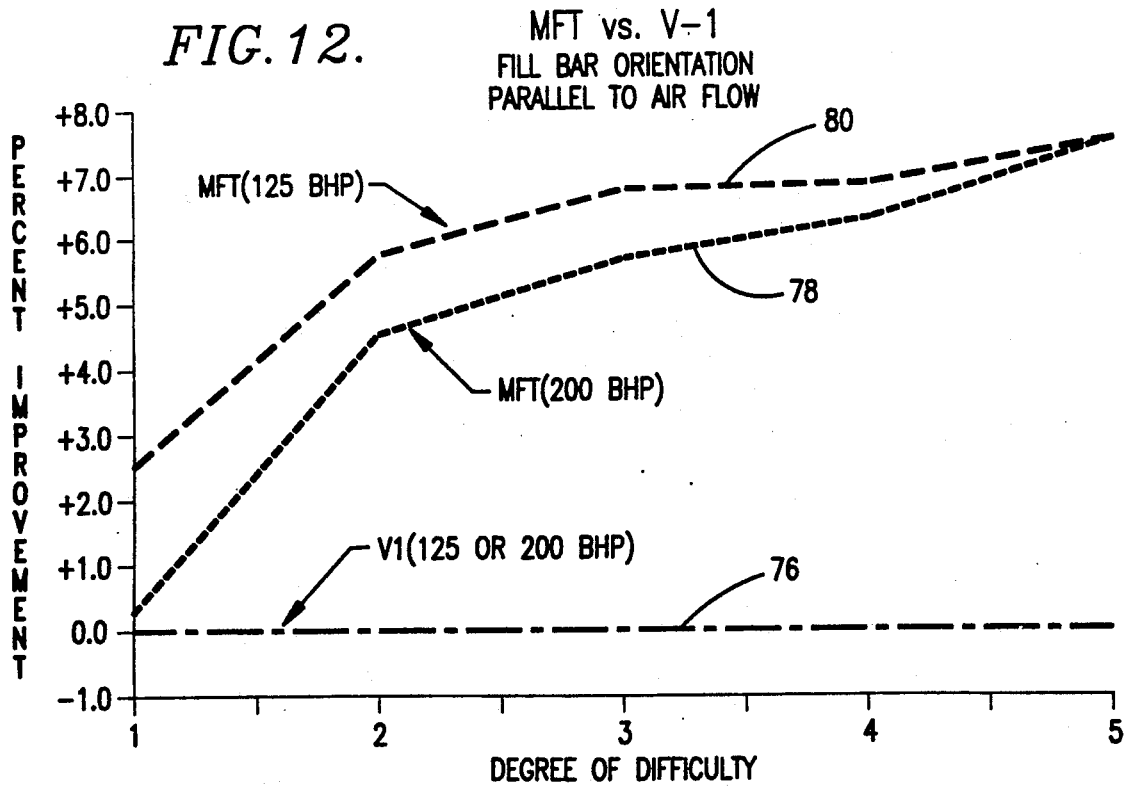

PERFORATED TRAPEZOIDAL-SHAPED FILL BAR FOR SPLASH TYPE WATER COOLING TOWERS

BACKGROUND OF THE INVENTION

1. Field of the Invention

The present invention is broadly concerned with an improved splash-type fill bar used in the fill assemblies of evaporative water cooling towers to enhance the performance thereof. More particularly, it is concerned with such an improved fill bar which is somewhat trapezoidally shaped in cross-section and presents an uppermost flat, relatively wide top wall, together with a pair of outwardly diverging, obliquely oriented sidewalls and a corresponding pair of laterally extending, side marginal flange walls extending from the lower edge of each sidewall; the top and sidewalls of the splash fill bar are apertured, whereas the flange walls are imperforate. Comparative tests using the fill bars of the present invention versus commercially available bars of inverted V configuration demonstrate that the bars hereof give enhanced tower performance.

2. Description of the Prior Art

In general, evaporative water cooling towers include an upper hot water distribution system such as an apertured distribution basin or the like, and a lowermost cold water collection basin. Commonly, a splash-type water dispersing fill structure is disposed in the spaced between the hot water distribution system and the underlying cold water collection basin. Such fill structure includes a plurality of elongated, horizontally arranged and staggered splash bars supported at spaced intervals by an upright grid structure. Hot water discharged from the distribution pan falls onto the bars and disperses, forming droplets to facilitate the cooling process. At the same time, cooling air currents are drawn through the fill structure, either by means of a motor driven fan or through use of a natural draft-inducing hyperbolic tower.

The fill structure of a given tower is often regarded as the single most important component, because the fill promotes interactive thermal interchange between the water and air. As water droplets are discharged from the distribution pan, the temperature difference between the relatively warm water and the cooling air causes evaporation on the surface of the droplets and cooling of the water occurs therefore at a rapid rate. However, as the surface temperature of individual droplets approaches the wet bulb temperature of the surrounding air, the cooling process is diminished and is dependent upon the rate of heat transfer from the inside of the droplet to the outside of the surface thereof. As such, it is desirable to interrupt the fall of individual droplets by splashing the drops on a fill bar, thus instantly exposing new water surfaces and, in some cases, subdividing the droplets into smaller droplets to increase the total water surface area available for exposure to the passing air.

As can be appreciated, the characteristics of any fill structure splash bar must meet several criteria to assure satisfactory operation and performance. First, the splash bar should provide consistent, predictable dispersal and breakup of the water droplets over a range of water loadings typically encountered in practice. Preferably, the descending droplets are uniformly broken into relatively fine particles in a widely divergent pattern to facilitate enhancement of the cooling process.

However, formation of a fine mist should be avoided, inasmuch as such mists can be readily entrained in the cooling air currents, and thus discharged to the atmosphere unless further steps are taken. Moreover, splash bar structure should cause a minimum amount of air pressure drop in order to keep fan horsepower requirements and operating costs at relatively low levels. Additionally, a splash bar structure should have sufficient structural strength to span the distance between adjacent upright grid supports, since deflection of the bars can enable the water to channel toward the low part of the bar, thereby causing coalescence of water and unequal water dispersal throughout the passing air streams. This problem of bar deflection is most common when the bars are formed of synthetic resin material, since such bars often lose strength and stiffness when subjected to the elevated temperatures of hot water to be cooled. Finally, cost is an important consideration in the selection and fabrication of splash bars. For example, a large hyperbolic induced-draft tower may utilize something on the order of 2,000,000 bars, each four feet in length. As a result, the use of bars formed of expensive metallic materials cannot usually be economically justified, even though metallic bars may provide very adequate performance.

Early splash bars were formed of wood species such as redwood or treated Douglas fir. However, wood splash bars, even when normally rot resistant, can deteriorate due to chemicals in the water stream. Also, wood bars present serious a fire hazard as soon as the water flow is interrupted and the moisture remaining on the bars has substantially evaporated.

It has also been proposed in the past to fabricate specialized bar configurations from synthetic resin materials. For example, U.S. Pat. No. 3,389,895 to DeFlon discloses various splash bar configurations, including those of inverted V configuration, and bars of inverted channel shape. The V-type bars described in this patent have achieved a measure of commercial usage, although they are relatively expensive. On the other hand, the inverted channel-shaped bars described in the '895 patent (see FIG. 5) are plagued with serious operational deficiencies. Specifically, such bars, because of the presence of upright, vertical sidewalls, tend to create coalesced streams or sheets of water which are inimical to tower performance. Therefore, these splash bars had achieved little, if any, commercial success.

U.S. Pat. No. 3,647,191 to Fordyce describes a splash fill bar of somewhat M-shaped configuration, presenting an apertured, V-shaped top wall presenting a pair of inclined wall sections, together with upright, imperforate sidewalls. This design has proved to be deficient in that descending hot water tends to collect in the central region of the top wall, thereby leading to unequal water distribution.

SUMMARY OF THE INVENTION

The improved splash bar of the present invention broadly includes an elongated body presenting a fore and aft extending, apertured, flat top wall having a pair of spaced side margins defining the width of the top wall, together with a pair of elongated, apertured, obliquely oriented sidewalls each having an upper and a lower edge and respectively extending from a side margin of the top wall. Moreover, the splash bar of the invention includes a pair of elongated, generally horizontal, outwardly extending imperforate flange walls respectively extending outwardly from a corresponding sidewall lower edge. Very importantly, the width of the top wall is at least four times the vertical height of one of the sidewalls, so that, in overall cross-sectional configuration, the splash bar of the invention presents a low trapezoidal shape. It has been found that this splash bar configuration gives significantly enhanced tower performance, without undue pressure drops and over substantially all commercially encountered duty requirements.

In particularly preferred forms, the splash bar is integral and formed of a synthetic resin material, particularly polyvinylchloride having a nominal wall thickness of 0.05 inches. Moreover, in order to stabilize the bars during use in a fill assembly, each bar is advantageously provided with a pair of elongated, depending feet, respectively extending downwardly from a sidewall edge to define laterally spaced apart support regions for the splash bar. Further, an elongated rib is oriented centrally between the top side margins and depends from the top wall between the spaced sidewalls; this rib serves to provide additional strength and precludes significant sag of the top wall during use.

BRIEF DESCRIPTION OF THE DRAWINGS

FIG. 11 is a graph representing a series of comparative tests to determine the cooling performances of the prior art inverted V-type splash bars versus the bars of the present invention, in the context of a crossflow cooling tower wherein the fill bars are located with the longitudinal axes thereof perpendicular to the flow of incoming cooling air currents; and FIG. 12 is a graph similar to that of FIG. 11, but depicting the comparative tests results in the context of a crossflow cooling tower wherein the fill bars are oriented with the longitudinal axes thereof parallel to the direction of incoming cooling air currents.

DETAILED DESCRIPTION OF THE PREFERRED EMBODIMENT

Figure 1:
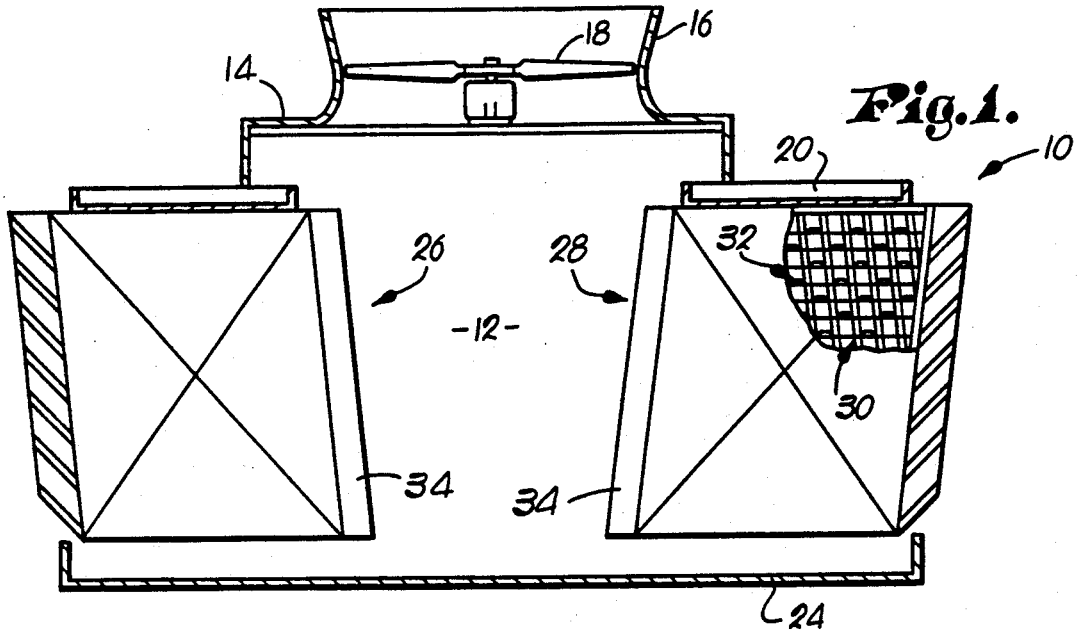
FIG. 1 is an essentially schematic cross-sectional view, with parts broken away for clarity, of a mechanical-draft crossflow water cooling tower having the splash bars of the present invention as a part thereof.

Turning now to the drawings, and particularly FIG. 1, a mechanical draft crossflow cooling tower 10 is schematically illustrated. The tower 10 includes an upright central plenum 12 surmounted by an apertured top wall 14, the latter being equipped with a venturi-type fan stack 16. A mechanically powered fan 18 is situated within stack 16, in the conventional manner. The overall tower 10 further includes a pair of laterally spaced apart hot water distribution basins 20, 22 for receiving hot water to be cooled and distributing the same via an apertured bottom wall forming a part of each basin. A common underlying cold water collection basin 24 is positioned beneath the basins 20, 22 and plenum 12. A pair of fill assemblies, broadly referred to by the numerals 26 and 28, are situated in spaced, opposed relationship beneath a corresponding distribution basin 20 or 22 in communication with plenum 12. Each of the fill assemblies 26, 28 is essentially identical, and includes an upright grid assembly 30 which support a plurality of elongated splash bars 32 serving to break up hot water descending from the overlying basin. The respective fill assemblies may also include a conventional, inboard drift eliminator 34 which serves to remove entrained water from the air currents leaving the fill sections.

As those skilled in the art will appreciate, in the use of tower 10 hot water is initially delivered to the basins 20, 22 whereupon it descends under the influence of gravity into and through the fill assemblies 26, 28. In the fill assemblies, water encounters the splash bars 32, which serves to break up the water into small droplets. Simultaneously, operation of fan 18 serves to draw incoming, crossflowing air currents through the outboard faces of the respective fill assemblies, so that such air comes into intersecting, thermal interchange relationship with the descending droplets. Such air currents pass through each of the fills 26, 28 and the inboard drift eliminators 34, whereupon they are commingled in plenum 12 and are exhausted to the atmosphere through stack 16. The cooled water gravitating from the respective fill assemblies is then collected in basin 24 for reuse.

Although the splash bars of the present invention find particular utility in crossflow cooling towers, the invention is not so limited. Specifically, bars in accordance with the invention may be used in counterflow towers if desired. Moreover, because of the lost cost and ease of manufacture characteristic of the splash bars of the invention, they are eminently suited for tower reconstruction projects wherein existing towers are refitted with new fill assembly components.

Figure 2:
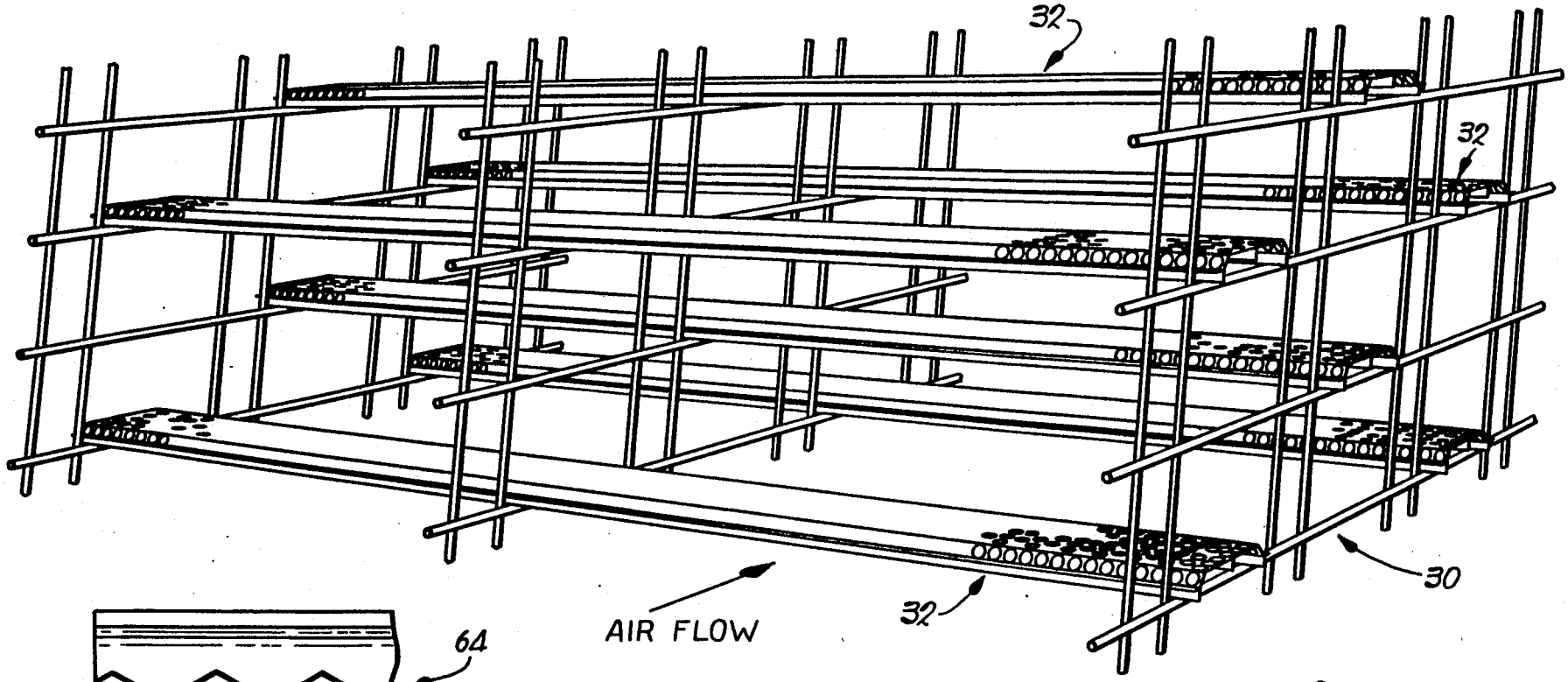
FIG. 2 is a fragmentary perspective view illustrating a portion of the tower fill section with the splash bars of the present invention being supported on upright grid structures.
Figure 7:
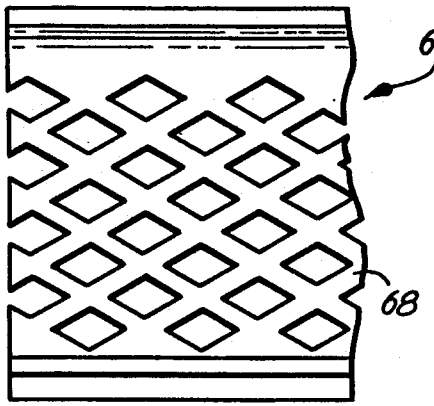
Fig. 7. PRIOR ART
FIG. 7 is a fragmentary view illustrating the construction of an inverted V-type splash bar of the prior art.

Attention is next directed to FIG. 2 which illustrates in more detail the use of splash bars 32 in accordance with the invention, in the context of a crossflow tower fill. It will be observed that the bars 32 are oriented transversely relative to the incoming cooling air currents (labeled "AIR FLOW" in FIG. 2), and are supported adjacent their ends by the upright grid assembly 30. The splash bar orientation depicted in FIG. 2 is preferred; however, if desired, the bars of the present invention can be used in contexts where they are oriented parallel to air flow, i.e., the longitudinal axes of the splash bars are parallel with the direction of travel of incoming cooling air currents.

Figure 3:
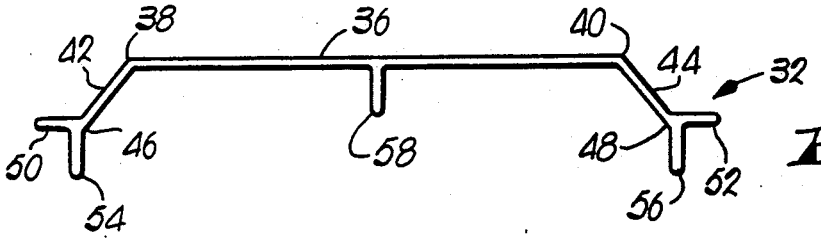
FIG. 3 is an end elevational view of a splash bar in accordance with the invention.
Figure 4:
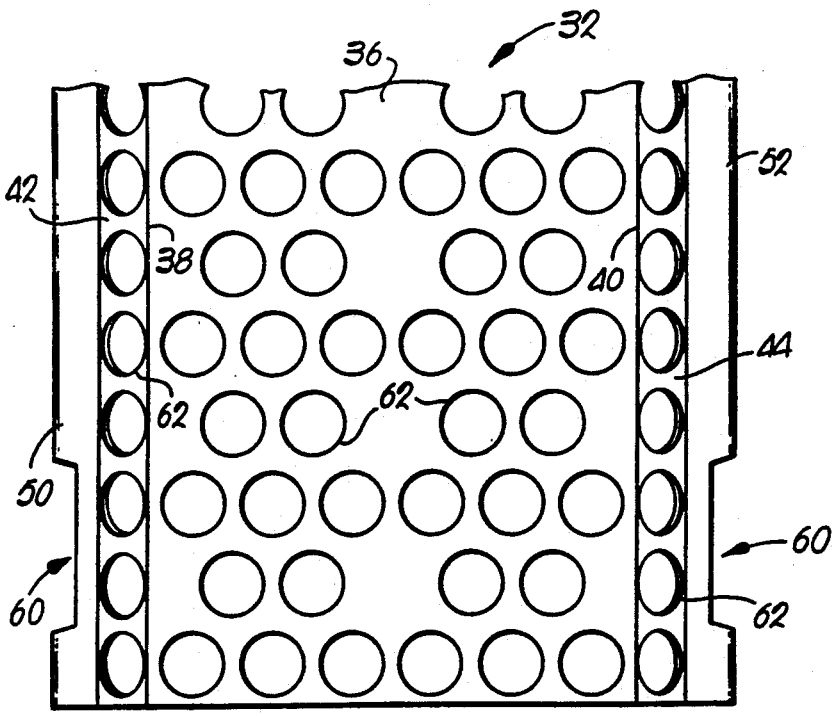
FIG. 4 is a fragmentary plan view of the splash bar depicted in FIG. 3.

Turning now to FIGS. 3–4, the specific preferred configuration of the splash bars 32 is illustrated. In particular, it will be observed that the splash bar 32 presents an uppermost, flat, apertured top wall 36 of elongated, fore and aft extending configuration and having a pair of side margins 38, 40 which together define the width of the top wall 36. A pair of apertured sidewalls 42, 44 of oblique, downwardly and outwardly diverging configuration respectively extend from each associated side margin 38 or 40, and each presents a lowermost side edge 46 or 48.

A pair of imperforate flange walls 50, 52 respectively extend from an associated sidewall edge 46, 48 in a laterally outward direction. Finally, the splash bar 32 includes a pair of depending foot walls 54, 56 respectively extending downwardly from a corresponding sidewall lower edge 46, 48, and a central, depending reinforcing rib 58 centrally located and depending from top wall 36. As shown in FIG. 4, the flange walls 50, 52 may be notched as at 60, in order to accommodate the splash bars of grid assembly 30 and thus assist in locking the splash bars in place.

As shown, the top wall 36 and oblique sidewalls 42, 44 are provided with a series of circular apertures 62 therethrough. These apertures are preferably circular and have a diameter of ⅜". Note in this respect that the aperture 62 provided in top wall 36 are staggered row-to-row, and apertures are omitted as necessary because of the presence of rib 58.

Figure 5:
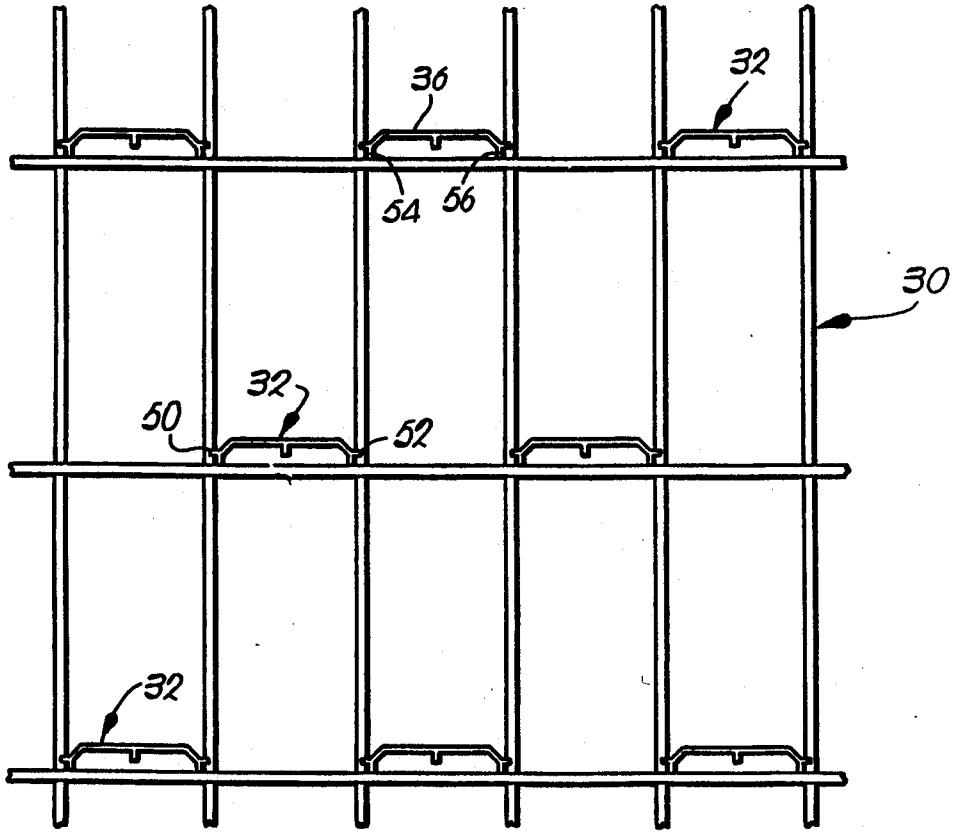
FIG. 5 is an end view of the fill assembly illustrated in FIG. 2.

In the preferred usage of the bars 32 in a fill assembly, the bars are oriented with the longitudinal axes thereof transverse to the direction of incoming cooling air currents, as depicted in FIG. 2. Moreover, the bars are normally staggered row-to-row as best seen in FIG. 5. In other instances, however, the bars may be oriented with the longitudinal axes thereof parallel to incoming cooling air currents. Moreover, the bars may be used in counterflow, as opposed to crossflow cooling tower applications.

Figure 10:
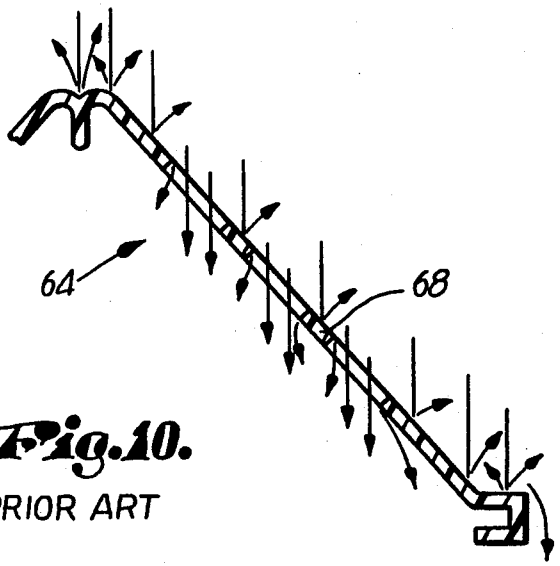
Fig. 10. PRIOR ART
FIG. 10 is an enlarged, fragmentary view taken along line 10—10 of FIG. 9, and illustrating the water dispersal characteristics of the prior art inverted V-type fill bar.
Figure 8:
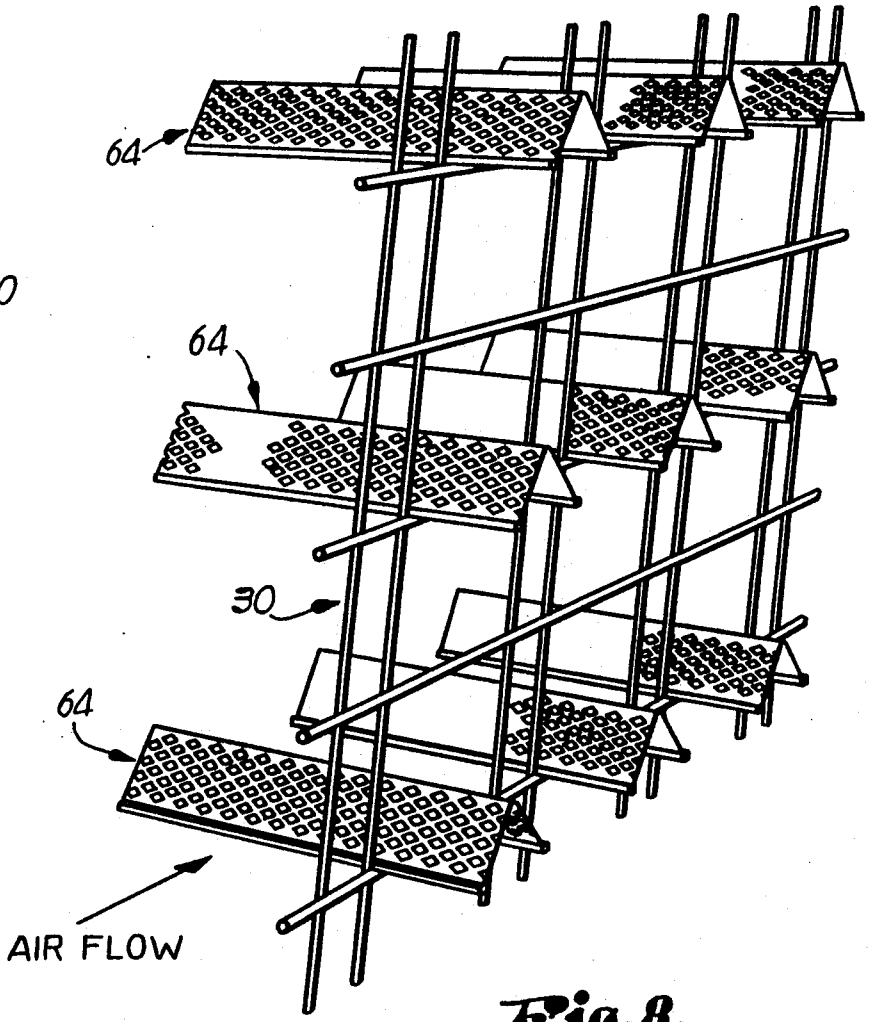
Fig. 8. PRIOR ART
FIG. 8 is a view similar to that of FIG. 2, but illustrating the use of prior art inverted V-type splash bars in the fill assembly.
Figure 9:
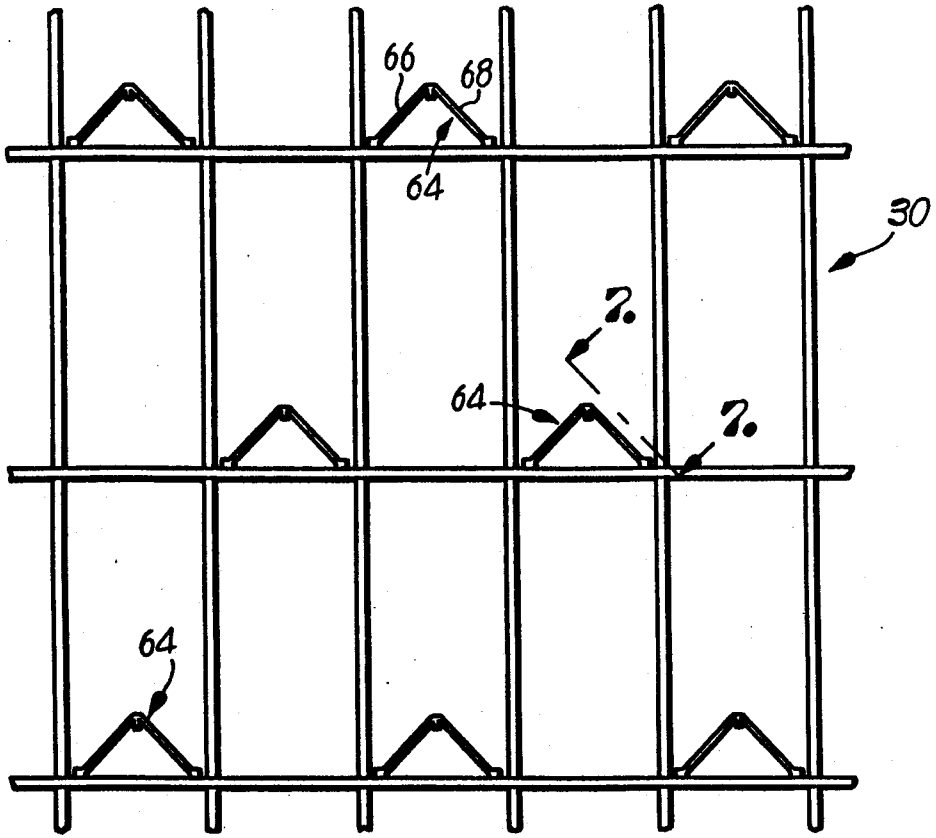
Fig. 9. PRIOR ART
FIG. 9 is an end view similar to that of FIG. 5, but again showing the use of inverted V-type fill bars as a part of the fill assembly.

FIGS. 8–10 depict conventional inverted V-type splash fill bars heretofore in commercial use and describe in DeFlon U.S. Pat. No. 3,389,895. In particular, these splash bars 64 are of inverted V-shaped configuration in cross-section, presenting a pair of flat, apertured, outwardly diverging sidewalls 66, 68. In this case, the sidewall apertures of are of diamond shaped configuration and the bars are used in the same manner as those of the present invention (compare FIGS. 8 and 9 with FIGS. 2 and 5).

In order to determine the cooling characteristics of splash bars in accordance with the invention, a series of comparative tests were undertaken to compare these bars, with the inverted V-shaped bars of the prior art. In all cases, the results were directly comparative, in that all parameters were maintained constant, save for the type of splash bar used. FIGS. 11 and 12 are graphical representations of these tests. In both cases, the graphs are of the Degree of Cooling Difficulty versus Percent Improvement. In the case of FIG. 11, for example (wherein the splash bars are oriented with the longitudinal axes thereof perpendicular to cooling air flow as shown in FIGS. 2 and 8), the performance of the prior art V-1 bar is plotted as a horizontal line 70, represented as a base line 0.0, for both fan horsepower ratings of 125 and 200. The performance plots for the splash bar in accordance with the present invention (denominated as a "MFT" bar) is given in plots 72 (200 fan horsepower) and 74 (125 fan horsepower). In both instances, the splash bar of the present invention gave significantly improved results, as compared with the prior art bar.

FIG. 12 is a similar situation, wherein the V-1 prior art bar's performance is represented by the horizontal line 76, again represented as a base line 0.0, with the performance of the splash bar of the present invention given by plots 78 (200 fan horsepower) and 80 (125 fan horsepower). Here again, the bars of the present invention gave improved results. It will be understood in this respect that the FIG. 12 tests were conducted with the splash bars oriented with their longitudinal axes parallel to the direction of incoming cooling air currents, and for this reason some degrees of improvement were not as significant as those shown in FIG. 11.

In all cases, the "Degree of Difficulty" is defined as the product of an arbitrary scaling coefficient C times the ratio of L/G at a base condition divided by L/G for a given operational condition. The base condition is an arbitrary hot water temperature, cold water temperature, and wet bulb temperature which are held constant for purposes of comparing various sets of conditions. The given condition is an arbitrary hot water temperature, cold water temperature, and wet bulb temperature to be achieved by the tower. The L/G at the base condition is the liquid (water) to gas (air) mass ratio required of the fill assembly to perform at the base condition, and the L/G at a given condition is the liquid (water) to gas (air) mass ratio required of the fill to perform at a given condition.

It will also be understood that, in the context of a large evaporative water cooling tower, seemingly small percentage improvements in tower performance represent a significant economic factor. Thus, if an electrical utility, for example, is cooling literally millions of gallons of water per unit time, the ability to lower the outgoing cool water temperature without corresponding increase in utility costs or undue pressure drop through the tower represents a significant savings.

Figure 6:
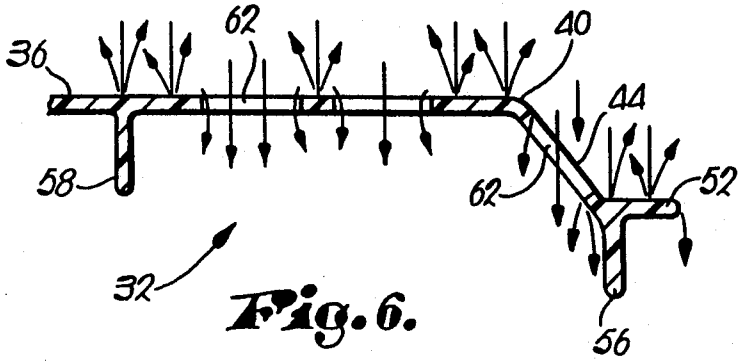
FIG. 6 is an enlarged, fragmentary view of a splash bar in accordance with the present invention, as showing the water dispersal characteristics thereof.

It is believed that the enhanced water cooling characteristics of the splash bars of the invention stems from the effective water dispersal characteristics thereof. Referring specifically to FIGS. 6 and 10, it will be seen that descending water striking the bar 32 (FIG. 6) results in significant dispersal and small droplet formation. At the same time, the relatively large openings permit free passage of small droplets through the splash bar so that effective cooling occurs throughout the fill. At the region of the oblique splash bar sidewalls 42, 44, significant dispersal is also effected, with the imperforate flange walls 50, 52 particularly aiding in this action. Formation of vertically descending films or sheets from the bar sidewalls is also inhibited because of these imperforate flange walls.

This cooling action is to be contrasted with that of the prior art splash bars, wherein a large multiplicity of diamond-shaped openings are provided. In this case, it is believed that droplet dispersal is lessened, and accordingly the cooling performance is lowered.

I claim:

1. A splash-type fill bar for evaporative water cooling towers and comprising:

an elongated body presenting an uppermost, fore and aft extending, apertured, flat top wall having a pair of spaced side margins defining the width of the top wall, a pair of elongated, apertured, obliquely oriented sidewalls each having an upper edge and a lower edge and respectively extending from a side margin of the top wall, and a pair of elongated, generally horizontal, outwardly extending imperforate flange walls respectively extending outwardly from a sidewall lower edge, the width of said top wall being at least four times the vertical height of one of said sidewalls.

2. The fill bar of claim 1, said body being integral and formed of synthetic resin material.

3. The fill bar of claim 1, said body being formed of polyvinylchloride.

4. The fill bar of claim 1, including a pair of elongated depending feet respectively extending downwardly from a sidewall lower edge to define a pair of laterally spaced apart support feet for the splash bar.

5. The fill bar of claim including an elongated rib oriented centrally between said top wall side margins and depending from the top wall between said sidewalls.

6. The fill bar of claim wherein said apertures are generally circular.

* * * * *